United States Patent [19]

Lemarquand et al.

[11] Patent Number: 4,635,013

[45] Date of Patent: Jan. 6, 1987

[54] ADDITIVE BLOCK COUPLABLE TO A CIRCUIT BREAKER

[75] Inventors: Pierre Lemarquand; Henri Pierrot, both of Dijon, France

[73] Assignee: La Telemecanique Electrique, France

[21] Appl. No.: 714,339

[22] Filed: Mar. 21, 1985

[30] Foreign Application Priority Data

Mar. 26, 1984 [FR] France ..... 84 04636

[51] Int. Cl.[4] ..... H01H 83/00

[52] U.S. Cl. ..... 335/20; 200/308

[58] Field of Search ..... 335/13, 17, 20, 18, 335/173, 174, 160; 200/308, 61.8, 324, 325, 153 G

[56] References Cited

U.S. PATENT DOCUMENTS 3,973,230 8/1976 Ciarcia et al. ..... 335/13

4,301,342 11/1981 Castonguay et al. ..... 335/17 X

*Primary Examiner*—Michael L. Gellner

*Assistant Examiner*—Brian W. Brown

*Attorney, Agent, or Firm*—William A. Drucker

[57] ABSTRACT

An additive block is provided which may be coupled to a circuit breaker comprising two separable contacts and a resettable tripping mechanism controlled by a thermal trip and/or a magnetic trip. It comprises an auxiliary tripping and/or signalling member, a connecting mechanism between the tripping mechanism of the circuit breaker and the auxiliary member and a manual resetting member cooperating with the connecting mechanism for resetting the active part of the mechanism associated with said auxiliary member in its original position after tripping of the circuit breaker. The connecting mechanism has an interlocking piece which may assume two positions corresponding to engagement and disengagement of the circuit breaker and cooperating in its first position with the resetting member for preventing manual actuation thereof.

11 Claims, 10 Drawing Figures

ADDITIVE BLOCK COUPLABLE TO A CIRCUIT BREAKER

BACKGROUND OF THE INVENTION

1. Field of the Invention

The present invention relates to an additive block which may be coupled to a circuit breaker.

2. Description of the Prior Art

Such additive blocks are generally used as residual differential current protective devices, shunt releases or trips, voltage minima trips or trips of any other kind capable of causing opening of the circuit breaker from a given signal. They may also be used as auxiliary signalling devices signalling on the spot or at a distance tripping of the circuit breaker.

As is known, a circuit breaker generally comprises at least two separable contacts and a tripping mechanism comprising a storage spring and a tripping shaft, this mechanism being controlled to separate the contacts by a thermal release and/or a magnetic release capable of acting more especially in the case of a short circuit or an over current; it also comprises a manual or motorized means for resetting the tripping mechanism.

In known additive tripping blocks, the trip generally comprises a release electromagnet and a mechanical energy storage spring held under tension by a catch mechanism; the release electromagnet only therefore requires low power for releasing the mechanism. The mechanical energy released causes breaking of the circuit by acting on the release shaft of the circuit breaker through an appropriate connection mechanism. After each tripping operation, it is again obviously necessary to reset the catch mechanism of the additive block manually for example by means of a lever.

The circuit breaker and the additive block have a means accessible from the outside and allowing mechanical transmission of the tripping action, either in the additive block-circuit breaker direction with a trip addition or in the circuit breaker-additive block direction with a signalling addition.

Known embodiments of such additive blocks therefore require resetting which is either independent or dependent on resetting of the circuit breaker.

In the first case, it is necessary to design a free tripping mechanism independent of the resetting lever of the additive block so as not to temporarily cancel out the action of the trip during this operation when the circuit breaker has been previously reengaged. This design has the drawback of leading to an expensive construction.

In the second case, the distinction between a contact opening action caused by the tripping additive block and such an action proper to the circuit breaker is not correctly displayed for the user. Correlatively, this solution excludes the use of circuit breakers with automatic reset which would have the disadvantage of not allowing the user to question himself about the causes of the fault detected by the additive block.

The purpose of the present invention is more especially to overcome the above-mentioned drawbacks of known apparatus by creating an additive block which may be coupled to a circuit breaker and which only allows the circuit breaker to be reset by a conscious and voluntary action on the part of the user.

SUMMARY OF THE INVENTION

According to the invention, in an additive block for a circuit breaker of the type described comprising in a case an auxiliary tripping and/or signalling member, and a connecting mechanism with, on the one hand, the mechanism for tripping the circuit breaker and, on the other hand, the auxiliary member for communicating a control movement to the first one in response to tripping of the second or vice versa, as well as a manual resetting member able to cooperate with the connecting mechanism for returning to its original position the active part of said mechanism associated with the auxiliary member after tripping of the circuit breaker; the connecting mechanism has a locking piece capable of assuming a first position and a second position corresponding respectively to engagement and disengagement of the circuit breaker, the locking piece cooperating in its first position with a manual resetting member for preventing manual actuation thereof and being retracted in its second position so as to allow actuation of a resetting member.

Inhibition of the manual resetting member, as long as the circuit breaker is engaged, is therefore provided using very simple mechanical means provided by the additive block of the invention in interdependence with the circuit breaker.

Preferably, the manual resetting member and the locking piece have stop means cooperating in the second position of this piece during manual actuation of the member so as to prevent temporarily resetting of the circuit breaker.

This simple arrangement provides a veritable interlocking between the resetting members of the circuit breaker and the additive block and increases the safety during use of the additive block-circuit breaker pair, since it compels the user first of all to reset the additive block which caused or signalled tripping of the circuit breaker and to question himself about the causes of the fault and to remedy them if necessary. The utility of this priority attributed to resetting of the additive block is evident when an automatic reset circuit breaker is used.

When the auxiliary member is a tripping member, the connection mechanism may comprise a pivotable transmitting lever urged by spring and supporting an indicating element; this lever is coupled to the tripping mechanism of the circuit breaker and cooperates through catch elements with a pivoting lever intermediate between said transmitting lever and the auxiliary member; the transmitting lever and the intermediate lever may have associated bearing elements for causing return of the intermediate lever at the end of the tripping stroke and pushing back with, if required, resetting of the auxiliary member. When this latter is a relay biased by a permanent magnet, its magnet circuit can thus be readily closed again.

When the auxiliary member is a signalling member, the connection mechanism may comprise a receiving lever supporting an indicator element and coupled to the tripping mechanism of the circuit breaker and operable by this mechanism, and cooperating by means of catch elements with an intermediate pivoting lever between said receiving lever and the auxiliary member.

The additive block may advantageously comprise a single spring urging, on the one hand, the transmitting or receiving lever and, on the other hand, the manual resetting member and, if included, a differential current test push-button.

BRIEF DESCRIPTION OF THE DRAWINGS

Other features and advantages of the invention will be clear from the following description with reference to the accompanying drawings in which.

DESCRIPTION OF THE PREFERRED EMBODIMENT

Figure 1:
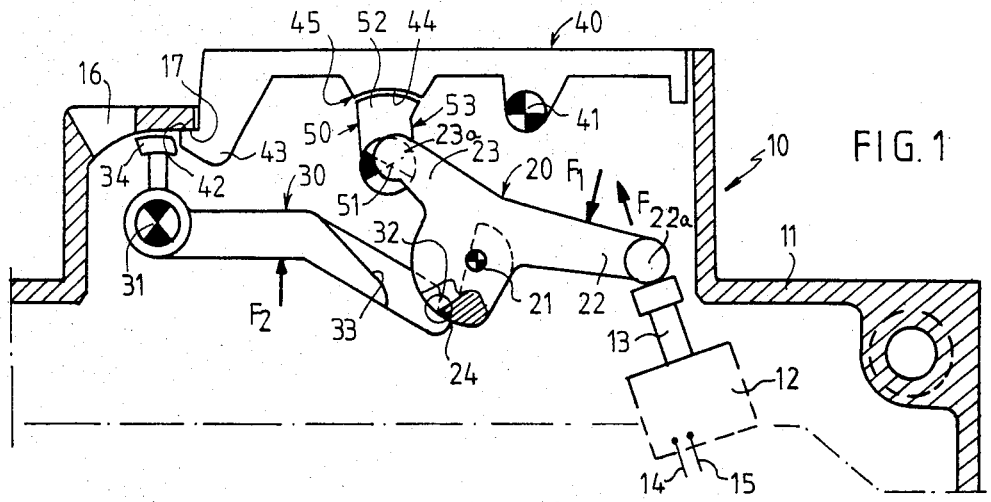
FIG. 1 shows a schematical side view in section of a first embodiment of a tripping additive block in accordance with the invention in the set position.
Figure 2:
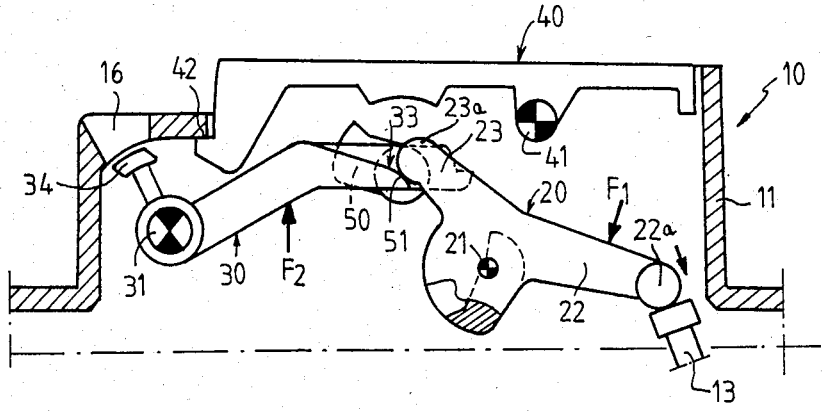
FIGS. 2 and 3 are similar views showing the additive block in its respective tripped and reset positions.
Figure 3:
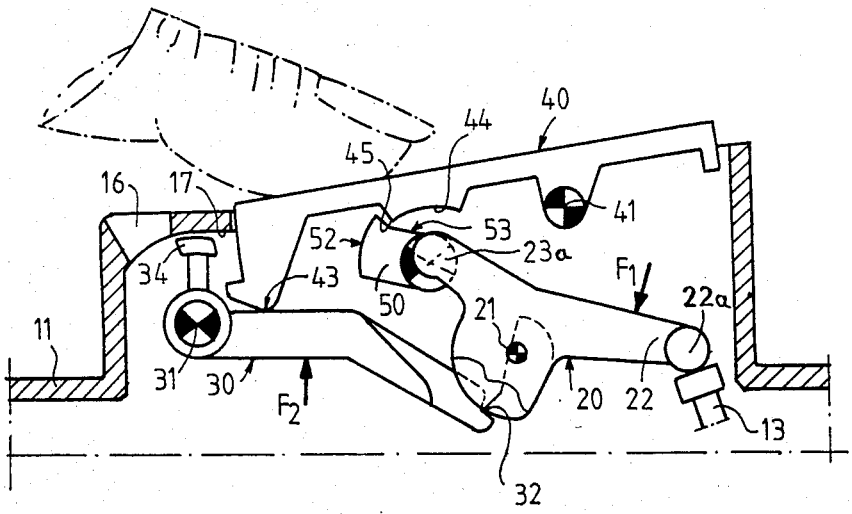

The additive block 10 of FIGS. 1 to 3, comprises in a molded casing 11 an auxiliary tripping member 12 having a push or pull piece 13, this piece being in the present case formed by a pusher and acting in the direction of arrow F in response to a voltage or current signal, for example a differential current appearing at the terminals of the auxiliary member 12 connected to the main circuit of the circuit breaker through conductors 14, 15.

Block 10 further comprises an intermediate lever 20. Lever 20 is mounted for rotation on a pin or on pivots 21 and it comprises a first arm 22 whose end 22*a* cooperates with the pusher 13 and a second arm 23 opposite the first one with respect to pin 21 and whose end 23*a* has a role which will be explained further on. Below pin 21, lever 20 has a nose 24. Lever 20 is subjected in a clockwise direction to a torque produced for example by the force of a spring shown schematically by the arrow F1 exerted on the arm 22 or by any other equivalent means.

A lever 30 for transmitting the tripping signal to the circuit breaker is mounted for rotation on a pin or on pivots 31 and it has on the same arm or on slightly divergent arms, on the one hand, a hook 32 adapted for engagement with the nose 24 of the intermediate lever 20 and, on the other hand, a ramp 33 adapted for engagement with end 23*a* of arm 23 so as to push this latter back in a clockwise direction and to return pusher 13 to its starting position as will be explained further on.

Lever 30 comprises above pin 31 and indicator element 34 visible in the tripped position (FIG. 2) through a window 16 in the case; lever 30 is further urged in an anticlockwise direction by a force represented at F2 and produced by a spring or any other equivalent means.

A manual resetting member 40 formed by a key, a lever or a push button is disposed on the front face of the case so as to be able to rotate about a pin 41 or pivots in an anticlockwise direction during a resetting operation (FIG. 3). It comprises at its left hand end a nose or stop 42 turned upwardly and intended to engage with a shoulder 17 provided on a face of the case as well as a finger, boss or other equivalent bearing element 43 turned downwardly and intended to push lever 30 back in a clockwise direction.

The resetting key 40 further comprises a concave shoulder 44 having an integral edge or nose 45. Shoulder 44 is adapted for engaging with locking lever 50, possibly provided with a cam. Lever 50 comprises a convex bearing surface 52 having a profile complementary to that of shoulder 44 and it is capable of rotating about a pin or pivots 51 so as to pivot in an anticlockwise direction when the circuit breaker is tripped (FIG. 2), and in a clockwise direction during resetting of the circuit breaker. Lever 50 has a lateral face 53 serving as a stop for nose 45 of key 40 during the resetting of the additive block (FIG. 3).

It should be noted that the pin 31 of lever 30 is coupled to a shaft or lever of the circuit breaker so as to deliver thereto the "outward" tripping information in the case of a tripping additive block or to receive the tripping information in the case of a signalling additive block, whereas pin 51 of locking lever 50 is coupled to a shaft or to a lever of the circuit breaker which sends to the additive block the "inward" tripping information of the circuit breaker.

The mechanical and kinematic arrangements described may of course be modified. In particular, while keeping the same direction of rotation for the intermediate lever 20, a lever 30 may be provided which pivots in a clockwise direction during tripping of the additive block.

Figure 4:
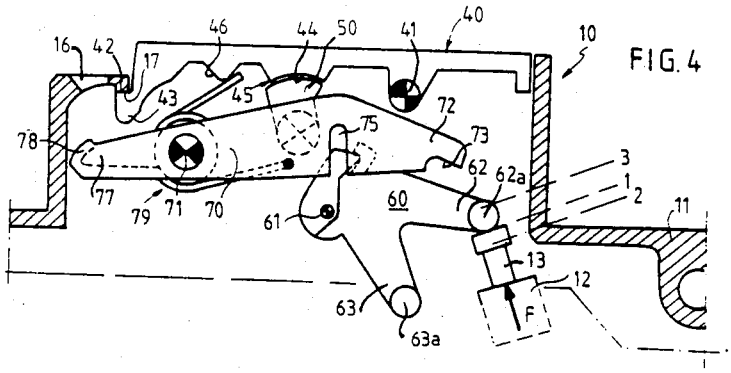
FIG. 4 shows in schematical cross section a second embodiment of a tripping additive block according to the invention in the set position.

The corresponding embodiment is shown in FIG. 4.

An intermediate lever 60 corresponding to lever 20 of FIG. 1 is shown pivoting about a pin 61 and has an arm 62 whose end 62*a* cooperates with the tripping pusher 13, a lower arm 63 whose end 63*a* cooperates at the end of tripping with a main lever 70 and a nose 64 provided for engagement with a nose of the main lever.

The main lever 70 may pivot about a pin 71 coupled to a shaft or to a lever of the circuit breaker so as to transmit thereto the tripping information from the additive block by clockwise rotation.

Lever 70 has an arm 72 with a bearing face 73 provided for engagement with the end 63*a* of the intermediate lever 60; it comprises on the same arm a hook 74 for engagement with the nose 64. A circular slit 75 is formed in arm 72 for limiting the angular travel of the lever 70 in a clockwise direction by abutment of pin 61 against the bottom of the slit. A torsion spring 76 bears on the one hand on a shoulder 46 of the resetting key 40 and, on the other hand, on arm 72 of lever 70; this latter finally has an arm 77 supporting an indicating element 78 adapted so as to appear opposite window 16 of case 11 in the tripped position of the additive block.

Operation of the embodiment shown in FIGS. 1 to 3 will now be described; operation of the variant shown in FIG. 4 only differs therefrom by the direction of rotation of lever 70.

In the state shown in FIG. 1, the additive block is set: the lever 50 occupies a position indicating that the circuit breaker is engaged and locks the resetting key 40. When the auxiliary control member 12, for example a measurement relay, is actuated in response to a current or fault detected on conductors 14, 15 pusher 13 moves in the direction of an arrow F and causes the intermediate lever to pivot in an anticlockwise direction about pin 21 against the torque determined by the spring exerting a small force $F_1$. Thus, nose 24 is freed from hook 32 and lever 30 pivots in the anticlockwise direction about axis 31 under the effect of the force spring $F_2$. The result is that the lever 30 transmits a tripping order to the tripping mechanism of the circuit breaker via the rotary pin 31 and the tripping indicator 34 becomes visible through window 16 of case 11 of the additive block (FIG. 2).

The tripping mechanism of the circuit breaker opens the separable contacts thereof and in return causes the cam lever 50 to rotate in an anticlockwise direction so as to bring it to the position shown in FIG. 2, with consequently unlocking of the resetting key 40.

In addition, at the end of travel, ramp 33 of lever 30 is applied against the end 23*a* of arm 23 and causes this latter to rotate in a clockwise direction so as to bring the pusher back in the reverse direction of arrow F; this allows the relay 12 to be reset, for example so as to avoid leaving its magnetic circuit open when it is a relay biased by a premanent magnet.

For resetting the circuit breaker, the user is forced to reset the additive block first of all for, otherwise, pin 31 remains in the position shown in FIG. 2.

Resetting of the additive block is then carried out as shown in FIG. 3 by manually rocking key 40 about its pin 41. Boss 43 is applied to lever 30 and drives it in a clockwise direction until the nose 24 of the intermediate lever slides over hook 32 and is held in the hook, whereas the indicator 34 disappears from window 16.

It will be noted that, during this resetting operation, nose 45 of key 40 is opposite the lateral face 53 of the locking lever 50 and prevents the circuit breaker from being engaged.

As soon as key 40 has come back to the position shown in FIGS. 1 and 2 under the effect of a resilient return means, the cam lever 50 may be brought back in its position for locking the key in response to resetting of the circuit breaker by the user.

Figure 5:
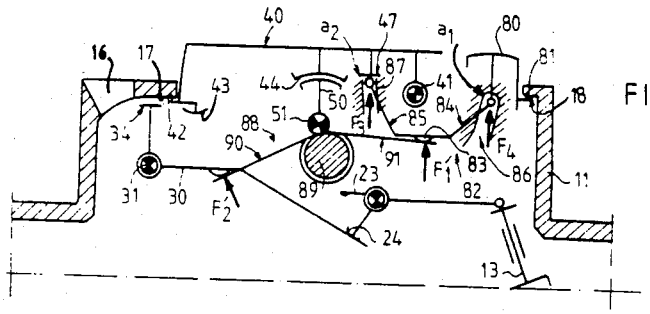
FIG. 5 shows similarly a third embodiment of a tripping additive block.

In the embodiment shown in FIG. 5, the additive block 10 has the function of detecting a residual differential current—by means of the measurement relay 12 with pusher 13—and also the function of tripping the circuit breaker following this detection. For this the block comprises a test push-button 80 having an abutment element 81 which may be applied against a shoulder 18 of case 11 under the effect of a spring. A lever 82 has, on each side of a fulcrum point 83, a first arm 84 bearing at $a_1$ on the pusher 80 and a second arm 85 bearing at $a_2$ on a projection 47 of key 40. The ends 84*a*, 85*a* of arms 84, 85 may slide in slides 86, 87 having an appropriate radius of curvature, substantially equal to the distance "d" between ends 84*a*, 85*a*.

A torsion spring 88 wound round a pin 89 comprises on one side of the pin a first arm 90 applied against a lower bearing point 35 on lever 30 and a second arm 91 applied against the bearing point 83 on lever 82. Spring 88 exerts respectively at 35 and 83 forces $F'_2$ and $F'_1$, force $F'_1$ being broken down into two forces $F_3$, $F_4$ urging respectively the resetting key 40 and the test push-button 80.

Operation of the additive block described in connection with FIG. 5 is substantially identical to that of the embodiments shown in FIGS. 1 to 4 as far as levers 20, 30, 40 and 50 are concerned.

However, during the operation for resetting the additive block, the projection 47 of key 40 moves down during pivoting of the key about its pin 41. Projection 47 causes a downward movement of the bearing point $a_2$ in slide 87 and, since bearing point $a_1$ remains fixed by abutment of element 81 of push button 80 against shoulder 18, causes a slight pivoting of lever 82 about $a_1$ in the anticlockwise direction; this movement of lever 82 is effected against force $F'_1$ of the torsion spring 88, one of whose functions is, as can be seen, to provide return of the key.

Actuation of the test push-button 80 causes the bearing point $a_1$ to move down in slide 86 and lever 82 to pivot about bearing point $a_2$ which remains applied against the projection 47 of key 40 following engagement of stop 42 against shoulder 17 of the case.

In another way, levers 20, 30, 40 and 50 may be disposed in a half case and push button 80, lever 82 and spring 88 housed in an adjacent half case, the two half cases forming the additive block.

Figure 6:
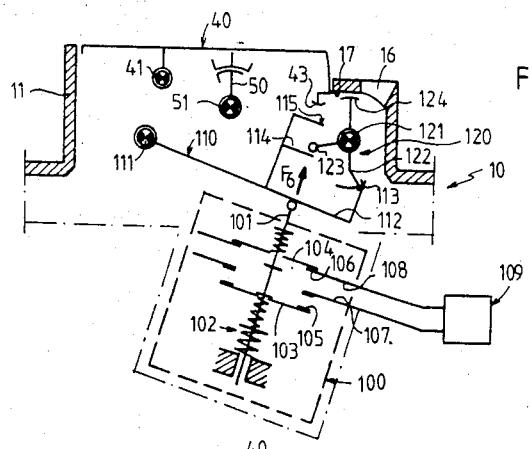
FIGS. 6, 7 and 8 show a fourth embodiment of an additive block according to the invention with signalling function in the respective set, signalling and reset positions.
Figure 7:
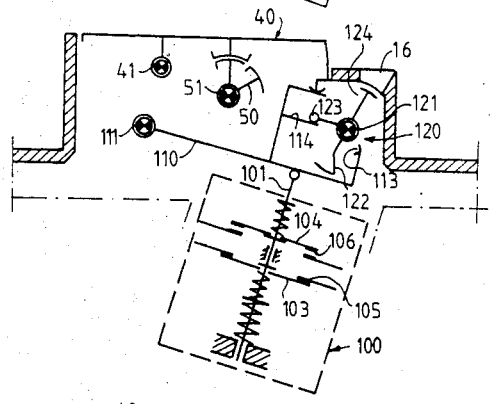
Figure 8:
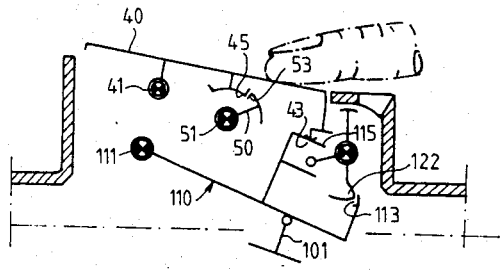

In the embodiment shown in FIGS. 6 to 8, the additive block no longer communicates a tripping order to the circuit breaker but receives therefrom the tripping information. Thus, this information is signalled, for example on the additive block and resetting of the circuit breaker is dependent on manual resetting of the additive block.

Case 10 of the additive block comprises key 40 and the interlocking lever 50 already described, as well as an auxiliary signalling assembly 100, an intermediate lever 110 and a receiving lever 120, coupled to the circuit breaker.

The signalling assembly 100 comprises a pusher 101 urged upwardly (FIG. 6) by a spring 102 and having two arms 103, 104, carrying contacts 105, 106 fastened to return means and movable along the axis of the pusher. Contacts 105, 106 are disposed respectively on conductors 107, 108.

The intermediate lever 110 is mounted for pivoting on a pin 111, as previously lever 20 on its pin 21, and it has an arm 112 with a nose 113 and a guide member 114 such as a ramp, slide, fork or other similar element. Element 114 has thereover a bearing face 115 provided for engagement with boss 43 of key 40.

The receiving lever 120 is mounted on a pin 121 and comprises a hook 122 which cooperates with nose 113, a finger 123 which cooperates with the guide fork 114 and an indicating element 124 adapted to appear opposite window 16 in case 11.

Pin 121 of lever 120 is coupled to a shaft or lever of the circuit breaker so as to rotate during tripping thereof in order, on the one hand, to make indicator 124 visible through window 16 and, on the other hand, actuate the contacts. In FIG. 6, the additive block is illustrated in its set position corresponding to the engaged state of the circuit breaker. The intermediate lever 110 is engaged on lever 120 and it is subjected to a holding force $F_6$ produced by the reaction of the springs of the auxiliary contact assembly 100. Contacts 105 are open and contacts 106 are closed, whereas indicator 124 is retracted.

Automatic or manual tripping of the circuit breaker causes lever 120 (FIG. 7) to pivot immediately in a clockwise direction, which frees hook 113 from nose 122; the springs associated with pusher 101 cause this latter to rise, which in its turn causes an anticlockwise rotation of lever 110 and reversal of the contacts of the signalling assembly 100, that is to say closure of contacts 105 and opening of contacts 106. Furthermore, the intermediate lever 110 confirms the movement of the receiving lever 120 by rotating while continuing to drive this latter through the guide fork 14 of finger 123.

Simultaneously, the cam lever 50, also coupled to the circuit breaker, is brought by the connection shaft thereof to the position illustrated in FIG. 7 so as to unlock the resetting key.

By pressing this key (FIG. 8), the intermediate lever 110, the receiving lever 120 and the signalling assembly 100 are reset in their original position shown in FIG. 6, through its boss 43. It should be noted that, during resetting of the additive block and as in all the preceding embodiments, edge 45 of shoulder 44 of key 40 prevents lever 50 from pivoting in an anticlockwise direction and consequently temporarily prevents resetting of the circuit breaker.

When an automatic reset circuit breaker trips, the user is therefore alerted of the effective tripping by the electric circuit which controls the signalling assembly 100 and he must reset the additive block by a conscious and voluntary action, which conditions the automatic resetting of the circuit breaker.

Figure 9:
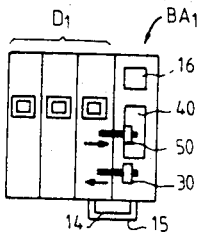
FIGS. 9 and 10 show very schematically one method of mounting the additive blocks of FIGS. 1 to 8.
Figure 10:
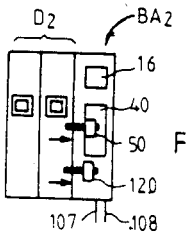

One example of coupling an additive block $BA_1$ such as shown in FIGS. 1 to 5 to a three pole circuit breaker $D_1$ has been shown in FIG. 9, whereas an example of coupling an additive block $BA_2$ such as shown in FIGS. 6 to 8 to a twin pole circuit breaker $D_2$ has been illustrated in FIG. 10. The direction of transmitting tripping information between the additive block and the circuit breaker has been shown in both cases by arrows.

A means for locking the resetting lever, which may be secured by a seal or a padlock if required, may be provided for preventing any unauthorized person from resetting the additive block and/or serving as locking device for the circuit breaker; this locking means may be formed by a drawer, a needle, a pin or any other similar member.

Furthermore, in the case where the additive block is a voltage failure or transmitting tripping block, a self break contact of the relay of said block may be advantageously associated with the transmitting lever 30 inside the additive block.

It goes without saying that other modifications may be made to the additive block described without departing from the scope and spirit of the invention.

In the embodiment of FIG. 5, a member locking resetting lever 40 may be advantageously provided, this member also maintaining test pusher 80 in its locking position, this being facilitated by the immediate neighborhood of lever 40 and pusher 80.

What is claimed is:

1. An additive block couplable to a circuit breaker comprising at least two separable contacts and having a set state in which said contacts are applied on each other and a tripped state in which said contacts are separated from each other, at least a main tripping mechanism adapted for separating said contacts in response to a control movement, at least a tripping element adapted for applying on said main tripping mechanism a first control movement and means for resetting said tripping mechanism, wherein said additive block comprises in a case:

an auxiliary tripping member adapted for generating a second control movement;

a transmission mechanism connecting said tripping mechanism of the circuit breaker and said auxiliary tripping member so as to communciate said first control movement to said auxiliary tripping mechanism and said second control movement to said main tripping mechanism, said transmission mechanism having an interlocking piece adapted for assuming a first position when said circuit breaker is in its set state and a second position when said circuit breaker is in its tripped state;

a manual resetting member adapted for having a reset position in which it engages the transmission mechanism so as to mechanically reset said auxiliary tripping member of the circuit breaker while said interlocking piece is in its second position, and a set position in which the interlocking piece in its first position is in engagement with said manual resetting member so as to prevent manual actuation thereof.

2. The additive block as claimed in claim 1, wherein said manual resetting member and said interlocking piece, have abutment means cooperating in the second position of said interlocking piece and during manual actuation of said manual resetting member for preventing resetting of the circuit breaker.

3. The additive block as claimed in claim 1, wherein said transmission mechanism comprises:

a pivoting transmitting lever having a pivot pin which is coupled to said main tripping mechanism and first catch elements;

a spring adapted for applying on said pivoting transmitting lever a force $F_2$;

an intermediate pivoting lever interposed between the transmitting lever and the auxiliary tripping member, said intermediate pivoting lever having second catch elements which cooperate with said first catch elements.

4. The additive block as claimed in claim 3, wherein said transmitting lever and said intermediate lever have engagement means associated so that the transmitting lever, at the end of a control stroke produced by tripping of the auxiliary member and rotation of the intermediate lever in one direction, causes the intermediate lever to be rotated in the other direction and resetting of the auxiliary tripping member.

5. The additive block as claimed in claim 4, wherein said auxiliary member is a polarized relay for detecting residual differential current.

6. The additive block as claimed in claim 1, wherein said pivoting transmitting lever comprises an indicating element visible through an opening formed in the case of the block should the additive block be tripped.

7. The additive block as claimed in claim 3, further comprising a single torsion spring urging said manual resetting member, on the one hand, so as to return it to a shoulder of the case and said transmitting lever on the other, so as to apply the force $F_2$ thereto.

8. The additive block as claimed in claim 3, wherein said manual resetting member comprises a first abutment surface, said additive block further comprising:

a residual differential current test push-button having a second abutment surface;

a first shoulder provided on the case and adapted for cooperating with said first abutment surface;

a second shoulder provided on the case and adapted for cooperating with said second abutment surface;

a rocking lever having two ends respectively in contact with said manual resetting member and said push-button, and a spring acting on said rocking lever in order to cause said first and second abutment surfaces to be applied

9. The additive block as claimed in claim 1, wherein said transmitting mechanism comprises a pivoting receiving lever having a pivot pin which is coupled to the tripping mechanism of the circuit breaker and which is in engagement through catch means with an intermediate pivoting lever interposed between said receiving lever and said auxiliary tripping lever, said intermediate lever and said receiving lever having means for confirming, in the tripped state, pivoting of said receiving lever by said intermediate lever.

10. The additive block as claimed in claim 9, wherein said pivoting receiving lever comprises an indicator element visible through an opening formed in the case of the block as long as the circuit breaker is in tripped state.

11. The additive block as claimed in claim 9, wherein said auxiliary member comprises reversal contacts controlling at least one electric signalling device.

* * * * *